US006016889A

United States Patent [19]

Pearcy et al.

[11] Patent Number: 6,016,889

[45] Date of Patent: Jan. 25, 2000

[54] FALL PROTECTION DEVICE INCLUDING TILTABLE BEARING

[75] Inventors: James L. Pearcy, Swoodridge; Frank A. Elbl, Addison, both of Ill.

[73] Assignee: Commonwealth Edison, Chicago, Ill.

[21] Appl. No.: 08/888,837

[22] Filed: Jul. 7, 1997

[51] Int. Cl.[7] ..... E06C 9/04

[52] U.S. Cl. ..... 182/3; 182/9; 182/133; 248/219.2

[58] Field of Search ..... 384/587, 619, 384/618, 571; 182/3, 9, 133; 212/253; 248/219.2

[56] References Cited

U.S. PATENT DOCUMENTS

| | | | |
|---|---|---|---|
| 896,406 | 8/1908 | Maxfield . | |
| 1,127,636 | 2/1915 | Kindred . | |
| 1,345,834 | 7/1920 | Chandler . | |
| 1,981,953 | 10/1934 | Frank . | |
| 2,072,573 | 3/1937 | Vigliotti | 116/73 |
| 2,155,897 | 4/1939 | Goldsworthy . | |
| 2,645,360 | 7/1953 | Raymond . | |
| 3,006,645 | 10/1961 | Frazier | 272/60 |
| 3,417,732 | 12/1968 | Platt, Jr. | 116/173 |
| 4,048,779 | 9/1977 | Valenziano | 52/726 |
| 4,103,642 | 8/1978 | Swenson | 116/174 |
| 4,485,891 | 12/1984 | Friess | 182/9 |
| 5,044,301 | 9/1991 | Peters et al. | 116/174 |
| 5,373,287 | 12/1994 | Doublet | 340/825.69 |
| 5,603,389 | 2/1997 | Zemon | 182/133 |
| 5,699,989 | 12/1997 | Guthrie . | |

OTHER PUBLICATIONS

Brochure, "Centerior Energy Presents the 'Harness Beam'"(undated).

Declaration of William S. Lythberg, Mar. 12, 1998.

*Primary Examiner*—Alvin Chin-Shue
*Attorney, Agent, or Firm*—Brinks Hofer Gilson & Lione

[57] ABSTRACT

A fall protection device for protecting a user from falling while climbing a pole includes a housing dimensioned to fit over a top end of the pole. THe housing comprises a closed end and an opposite open end, through which the top end of the pole is received. In one embodiment, a pivot pin is fixedly connected to and extends upwardly from the closed end of the housing in a substantially vertical direction. A swing arm assembly includes an extended portion connected to a hollowed swing portion having a swing axis and an interior surface. The swing portion is dimensioned to receive the pivot pin and to house at least two bearing assemblies. Each of the bearing assemblies is axially disposed between the pivot pin and the interior surface of the swing portion. In another embodiment, the swing arm assembly includes a cam follower assembly connected to the extended portion. The cam follower assembly includes a support component spaced apart from a suport defined by the closed end of the housing when the swing axis and the pole axis are coincident. The support component engages the support surface when the swing axis becomes angularly diposed with respect to the pole axis. A method is also provided for providing fall protection from a pole using a fall protection device.

21 Claims, 3 Drawing Sheets

FALL PROTECTION DEVICE INCLUDING TILTABLE BEARING

FIELD OF INVENTION

The present invention relates to a fall protection device. In particular, the present invention relates to a device that protects against fall and allows free rotation about a pivot even when the device is axially tilted with respect to the pivot.

BACKGROUND OF INVENTION

Technological infrastructure have relied upon utility poles to carry overhead lines or cables typically for supporting power generation, transmission and distribution lines, telephone lines and more recently cable television lines. In order to service the various overhead lines or cables ("utility lines"), a lineman is often required to climb the utility pole. The lineman ascending a pole may use a retractable line anchored near the top of the utility pole for protection from a fall as well as for facilitating the climb. In addition, such a safety device may be used by a trainee learning to climb a utility pole and to service the utility lines carried on top of the utility pole.

More recently, regulations promulgated by the United States Occupational Safety & Health Administration (OSHA) require that a personal fall arrest system shall be used by unqualified employees (including trainees) working at elevated locations more than four feet (1.2 meters) above the ground on poles, towers and similar structures. Even qualified employees are required to use a personal fall arrest system in conditions that could cause the employee to lose his or her grip or footing, such as ice, high winds, design of the structure (for example, no provision for holding on with hands), or the presence of contaminants on the structure. According to OSHA regulations, the personal fall arrest system must be able to support a 5,000-pound weight.

While trainees are required to use a personal fall arrest system for safety reasons, it is desirable that the trainees do not depend upon the fall arrest system during their training. Therefore, it is desirable to provide a personal fall arrest system that allows the trainees to learn to climb unencumbered up and down a utility pole. For example, it is desirable to have a personal fall arrest system that provides a minimum amount of resistance to rotational forces, even when the device is not vertically aligned to the pole. In addition, the fall arrest system should evenly distribute the load applied by the climber. Moreover, it would be desirable that such a fall arrest system requires low maintenance.

SUMMARY OF THE INVENTION

The present invention relates to a fall protection device for mounting on top of a pole. The device includes a housing with a closed end and an opposite open end that is dimensioned to fit over the pole; a pivot pin connected to the housing's closed end; a swing arm assembly including an extended portion connected to a hollowed swing portion which is dimensioned to receive the pivot pin and further dimensioned to house at least two bearing assemblies. Each of the bearing assemblies being disposed between the pivot pin and the interior surface of the swing portion. Thus, the bearing assemblies permit free rotation of the swing arm assembly about the pivot pin when the pin is angularly disposed or at a tilt with respect to the pole.

In a preferred embodiment of the present invention, each of the bearing assemblies is a tapered roller bearing assembly. In another preferred embodiment, the device further includes a thrust bearing assembly. In a yet further preferred embodiment, the device includes a cam follower assembly connected to the extended portion to further support rotation, especially when the pin is at a tilt with respect the pole.

The present invention further relates to a method for providing fall protection by providing a fall protection device as previously described.

The preferred device of the present invention requires low maintenance since the bearings are easily accessible and replaceable. In addition, the preferred device allows a trainee to reach the entire length of the pole, including the top of the pole, unencumbered.

The invention itself, together with further objects and attendant advantages, will best be understood by reference to the following detailed description, taken in conjunction with the accompanying drawings.

DETAILED DESCRIPTION OF THE PREFERRED EMBODIMENTS

Figure 1:
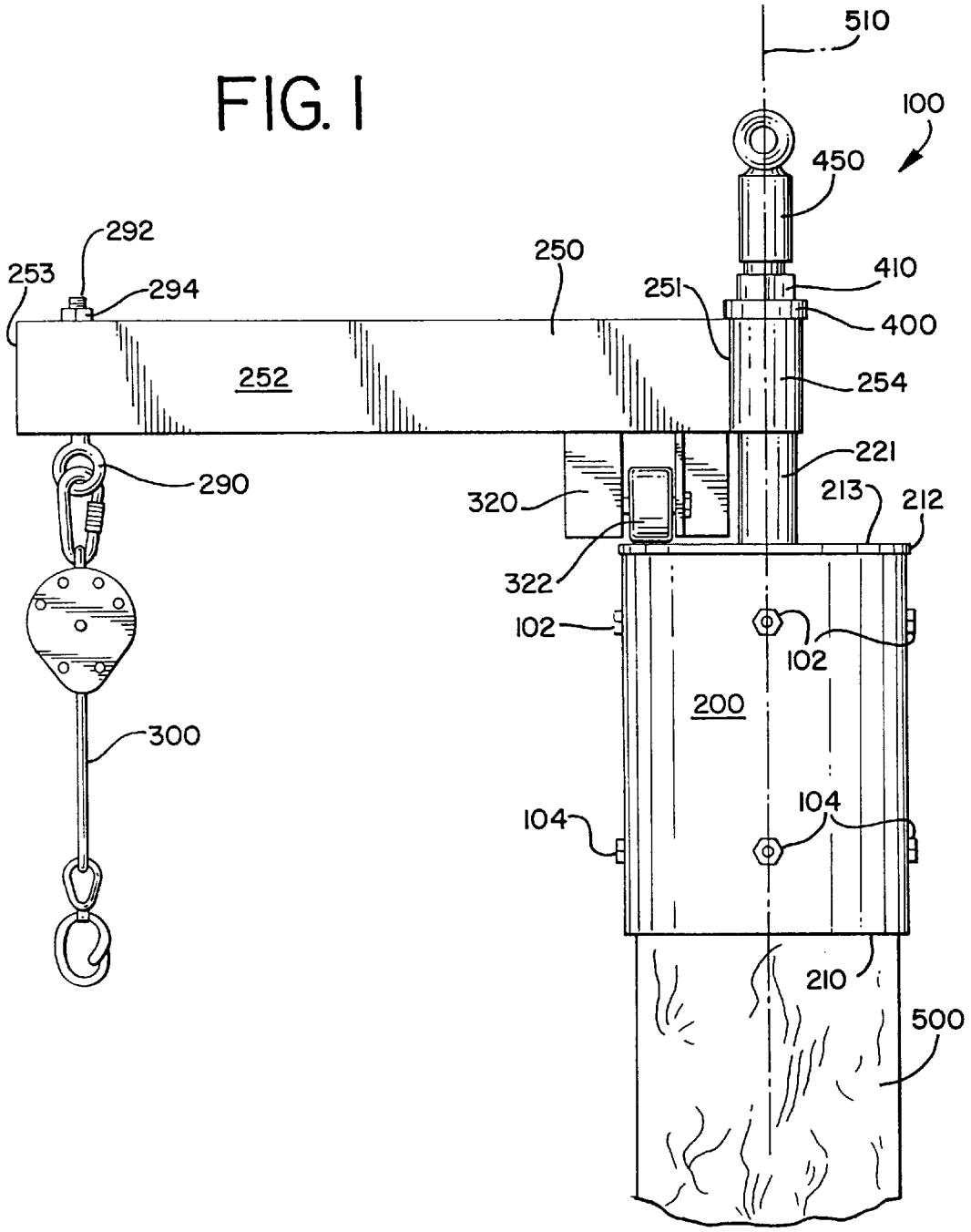
FIG. 1 is a perspective view of a fall protection device of the present invention installed on top of a pole.

As shown in FIG. 1, a fall protection device 100 of the present invention is mounted on the top of a pole 500 to give trainees the ability to free-climb the pole and move 360 degrees around the pole without the impediments of cumbersome ropes and slings. The device 100 generally includes a housing 200, a pivot pin 220, a swing arm assembly 250 and a lift portion 450.

Figure 2:
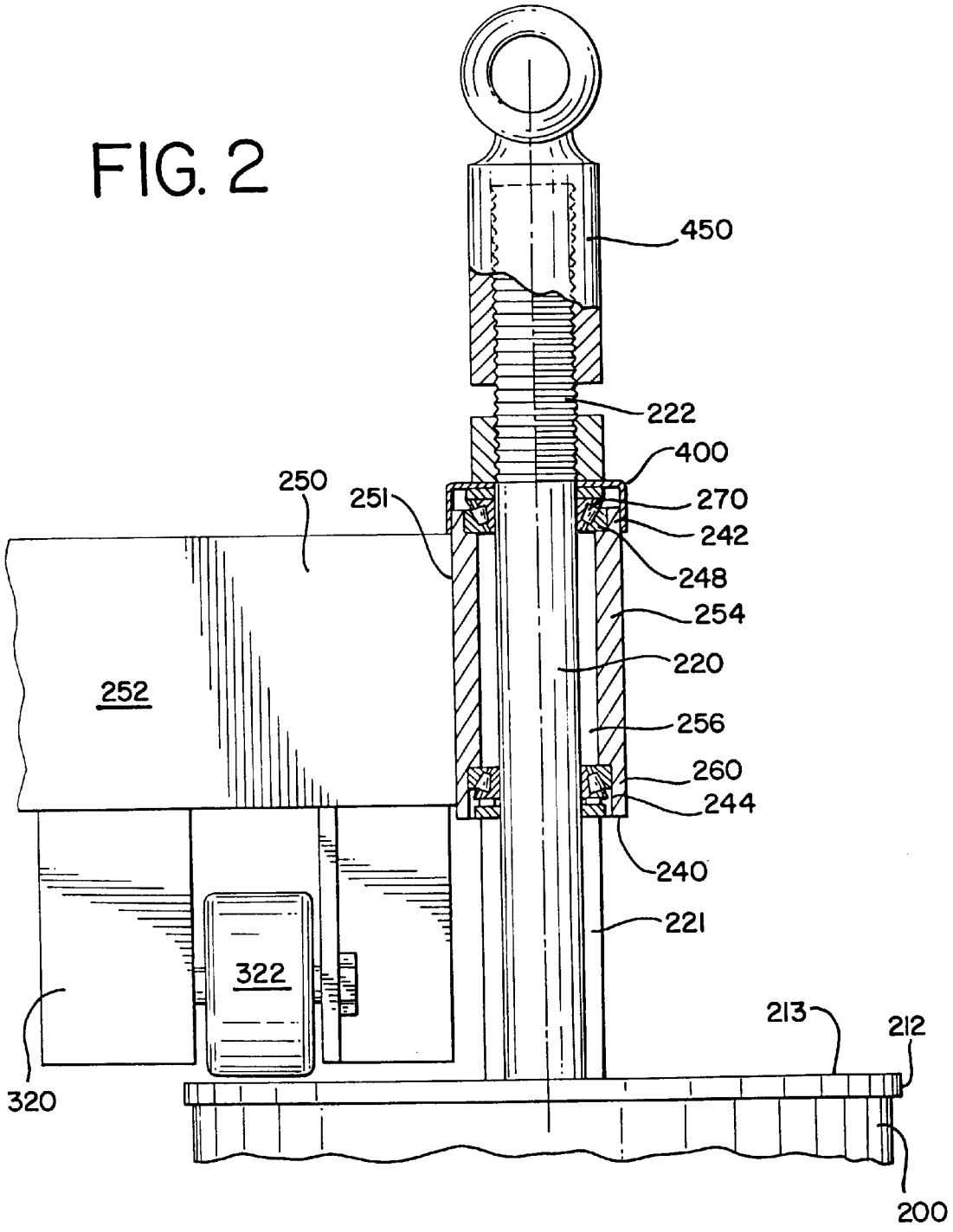
FIG. 2 is a cross-sectional view of a portion of the fall protection device of FIG. 1.

As best seen in FIG. 1, the housing 200 with an open end 210 and a closed end 212 having an exterior surface 213 and an opposing interior surface (not shown). Four apertures (not shown) designed to receive bolts 102 are positioned equidistant from each other about the circumference of the upper half portion of the housing 200. Similarly, four additional apertures (not shown) designed to receive bolts 104 are positioned equidistant from each other about the circumference of the lower half portion of the housing 200. Bolts 102, 104 are used to secure the fall protection device 100 to the pole 500. The solid pivot pin 220 includes a pivot pin base 221 that is welded to the exterior surface 213 of closed end 212 of the housing 200. The pivot pin base has a diameter that is greater than that of the pivot pin 220. As best seen in FIG. 2, pivot pin 220 further includes a threaded portion 222.

Figure 3:
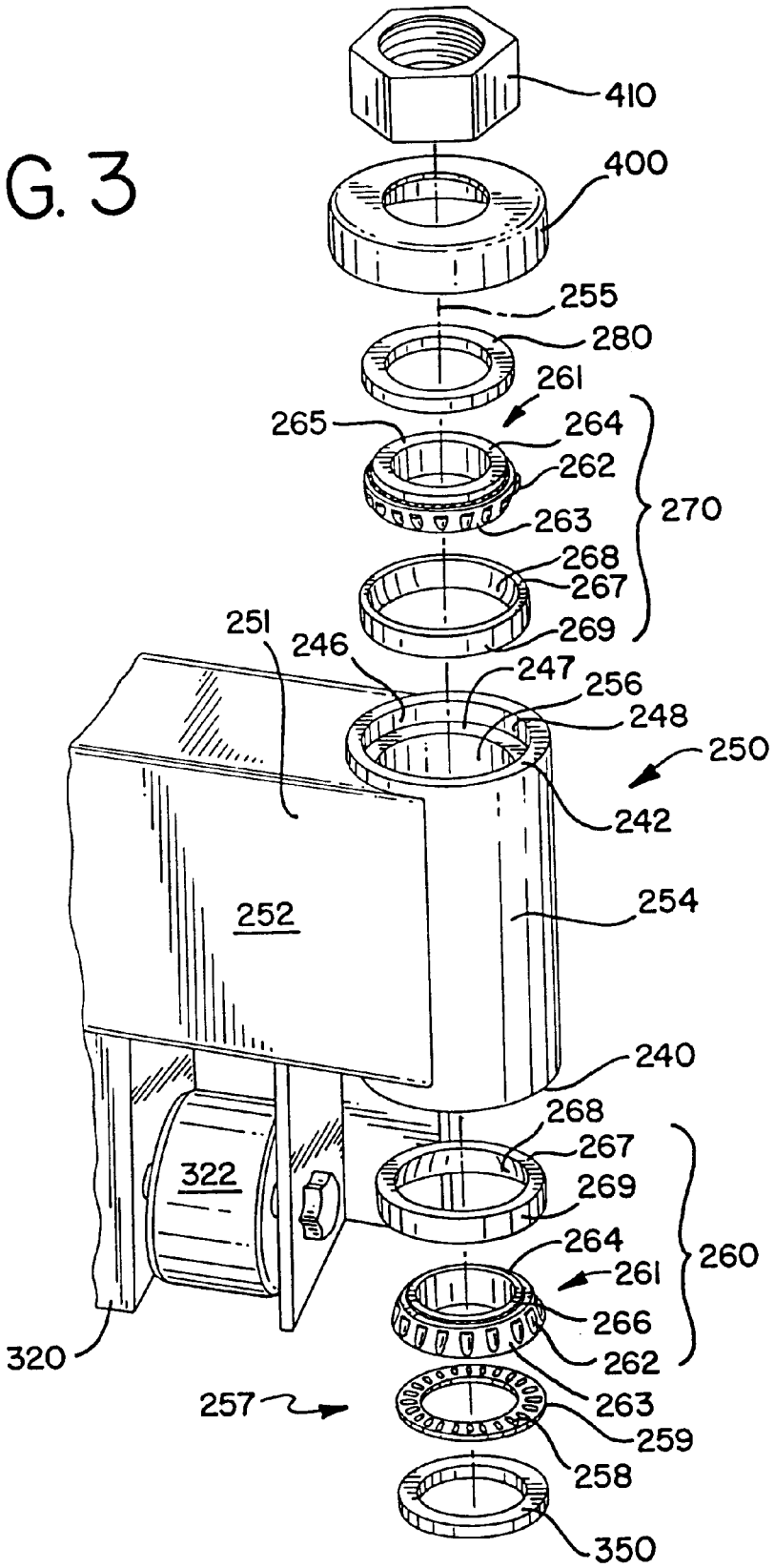
FIG. 3 is an exploded perspective view of components adjacent to the swing arm assembly in the fall protection device of FIG. 1.

As best seen in FIG. 2, the pivot pin 22 is received by a hollow swing portion 254 of the swing arm assembly 250. As best seen in FIGS. 1-2, the swing arm assembly 250 is generally made up of an extended portion 252 and the swing portion 254. As best seen in FIG. 1, the extended portion 252 has a first end 251 adjacent to the swing portion 254 and an opposite second end 253. The swing portion has a first terminal end 240 adjacent to the closed end 212 and an opposite second terminal end 242. As best seen in FIGS. 1 and 3, the swing portion 254 has a central axis 255 ("swing axis"), which, at initial installment of the device 100, is coincident with the central axis 510 ("pole axis") of the pole 500. As best seen in FIGS. 2-3, the swing portion 254 includes a tubular opening 256. The hollow swing portion 254 houses a lower tapered roller bearing assembly 260 and an upper tapered bearing assembly 270. As best seen in FIG. 2, the first terminal end 240 includes a recess 244 dimensioned to receive the lower tapered roller bearing assembly 260. As best seen in FIGS. 2-3, the second terminal end 242 includes a recess 248 dimensioned to receive the upper tapered roller bearing assembly 260. As best seen in FIG. 3, recess 248 has a cylindrical interior surface 246 and a terminal interior surface 247. Although not shown, recess 244 also has a cylindrical interior surface and a terminal interior surface. As best seen in FIG. 2, the bearing assemblies 260, 270 is disposed within their respective recesses 244, 248 such that each bearing assembly 260, 270 is disposed axially between the pivot pin 220 and the cylindrical interior surface 246 of the recess 244, 248. The term "axially between" mean, for example, along a line that is perpendicular to the swing axis 255.

As best seen in FIG. 3, each roller bearing assembly 260, 270 includes a cup component 261, containing embedded rollers 262 that penetrate the thickness of a cup surface 263. The cup component further includes a roller support or bore 264 having a first terminal surface 265 and a second terminal surface 266. The embedded rollers 262 engage the roller support 264 of the cup component and a cone component 264. As best seen in FIG. 3, a thrust ring 280 is disposed to engage the first terminal surface 265 of cone component 264 in the upper tapered roller bearing assembly 270. Preferably, the thrust ring 280 is disposed within recess 244. The first terminal surface 265 of the cone component 264 in the lower tapered roller bearing assembly 260 is disposed to engage a thrust washer bearing 257. As best seen in FIG. 3, the thrust washer bearing 257 contains embedded rollers 258 that penetrate the thickness of a washer surface 259. The thrust washer bearing 257 is disposed adjacent a spacer ring 350. As best seen in FIG. 2, the spacer ring 350 rest upon the pivot pin base 221.

The upper bearing assembly 270 of the assembled device 100 is accessible by removing from the pivot pin 220 the lift portion, the nut 410 and the rain cap 400. The lower bearing assembly 260 and the thrust bearing 257 are accessible by further removing the hollow swing portion 254 from the pivot pin 220.

The upper and lower tapered roller bearing assemblies 260, 270, assisted by the thrust washer bearing 257, allow the swing arm assembly 250 to freely rotate 360 degrees about the pivot pin 220 without rotation resistance that would be detectable to the wearer. The tapered roller bearing assemblies 260, 270 allow such free rotation even when swing portion tilts such that the swing portion's 250 central axis 225 becomes angularly disposed to the pole's 500 central axis 550.

The term "freely rotate" refers to rotation with minimal amount of resistance to rotational forces applied to the swing arm assembly 250. In a preferred embodiment, the resistance to rotation imposed by the arrangement should be less than about five pounds of force, more preferably about three pounds of force, thus allowing the extended portion 252 to follow maneuvering around the pole 500 without any wrap around of line 300 about the pole 500 during such maneuvering.

A cam follower assembly 320 that can run on the exterior surface 213 of the closed end 212 further provides support of the swing arm assembly 250. The cam follower assembly 320 includes a wheel component 322 that is designed to engage the external surface 213 only when the central axis 255 of the swing portion 254 is angularly disposed with respect to the central axis 510 of the pole 500. Therefore, the cam follower assembly 320 provides a back-up support bearing in cases where a user's weight causes the swing portion to tilt beyond a certain safety range.

As best seen in FIG. 1, the extended portion 252 contains a safety ring 290 attached to the extended portion 252 by a safety bolt 292 and a safety nut 294. The safety ring 290 is provided to secure a safety line 300 to the fall protection device. The safety line 300 may then be secured to a body harness (not shown) worn by the climber.

The safety line 300 can be any lanyard suitable for arresting the fall of a user. For example, the safety line 300 may be a retractable line such as Model S 52 and 55 Self Retracting Life Line, available from Miller Equipment of Franklin, Pa.

A rain cap 400 is provided to cover the entire circumference of the swing portion 254, including the upper tapered roller bearing assembly 270, to protect the bearings 260, 270 from the environmental elements and thereby prolong the useful life of these bearings. A nut 410 secures the swing portion 254, upper and lower bearing assemblier 260, 270, thrust bearing 257, spacer ring 350, thrust ring 280 and rain cap 400 to the pivot pin 220. Preferably, at least a portion of the nut 410 includes a nylon interior surface (not shown) that intimately receives threading of the threaded portion 222. An example of a preferred nut 410 is a Nylock nut, available from SCI Corporation of Streeter, Ill. This nut 410 allows for easy assembly of the device 100.

As best seen in FIG. 1, the lift portion 450 is attached to the fall protection device 100 via the threaded portion 222. The lift portion 450 is used to attach the assembled fall protection device 100 to a crane (not shown) during the installation the fall protection device 100 on top of a pole. Any installation and centering procedure can be for installing the device of the present invention on top of a pole. An example of a suitable attachment and centering procedure is described in U.S. Pat. No. 5,603,389 issued to Zemon, which is incorporated herein by reference.

A device of the present invention is described in the example below.

EXAMPLE

A fall protection device of the present invention having the configuration illustrated in previously described FIGS. 1–3 was constructed. The device included components having the dimensions listed in Table 1 below.

TABLE 1

| | | FIG.(s) | Dimension | |
|---|---|---|---|---|
| Component | Ref. No. | Showing Component | Description | Measurement (inch) |
| housing | 200 | 1 | height | 5 |
| housing open end | 210 | 1 | diameter | 2.5 |
| housing closed end | 212 | 1 | diameter | 2.25 |
| pivot pin | 220 | 2 | diameter | 1.5 |
| | | | height | 10 |
| pivot pin base | 221 | 1, 2 | diameter | 2.25 |
| | | | height | 4.25 |
| threaded portion | 222 | 2 | height | 4.5 |

TABLE 1-continued

| Component | Ref. No. | FIG.(s) Showing Component | Dimension Description | Measurement (inch) |
|---|---|---|---|---|
| swing arm assembly | 250 | 1, 2, 3 | length | 34.25 |
| extended portion | 252 | 1, 2, 3 | height | 4.50 |
| | | | width | 2.50 |
| swing portion | 254 | 1, 2, 3 | diameter | 3 |
| | | | height | 5.5 |
| first recess | 244 | 2 | height | 4.375 |
| | | | diameter | 2.50 |
| second recess | 248 | 2, 3 | height | 4.375 |
| | | | diameter | 2.50 |
| thrust bearing | 257 | 3 | bore diameter | 1.5 |
| | | | outside diameter | 2.187 |
| | | | thickness | 0.1880 |
| spacer ring | 350 | 3 | gauge | 0.1875 |
| | | | diameter | 2.5938 |

The cup component 261 of roller bearing assembly 260, 270 was available as part no. 1390, while the cone component was available as part no. 13830 (bearing and cone, with 1.5-inch bore and 0.4688-inch width) from Timken Bearings. The thrust bearing was also available from Timken Bearings. The gap between the wheel component (322, FIG. 1) of the cam follower and the exterior surface (213, FIG. 1) of the closed end (212, FIG. 1) of the housing (200, FIG. 1) measured 0.0015 inch when the swing axis was parallel to the central axis of the pole.

This device met the requirements of OSHA regulation 29 C.F.R. § 1926. In addition, the device was capable of withstanding (without breaking) a 5,000 pound of load. Furthermore, the device was able to fit a pole having a diameter of up to 11 inches. Moreover, the swing arm assembly was rotatable about the poles with less than 3 pounds of force. A climber using this was able to access the top 18 inches of the pole.

The device of the present invention has a longer useful life than known fall arrest safety system. The bearings can be easily replaced since they are easily accessible.

Of course, it should be understood that a wide range of changes and modifications can be made to the embodiments described above. It is therefore intended that the foregoing description illustrates rather than limits this invention, and that it is the following claims, including all equivalents, which define this invention.

We claim:

1. A fall protection device for protecting a user from falling while climbing a pole, said device comprising:

said pole having a top end and a pole axis;

a housing dimensioned to fit over the top end of said pole, said housing having a closed end and an opposite open end, wherein said top end of said pole is received through said open end of said housing and said housing is disposed on said top end of said pole;

a pivot pin fixedly connected to and extending upwardly from the closed end of said housing in a substantially vertical direction;

a swing arm assembly including an extended portion connected to a hollowed swing portion, said swing portion having an interior surface and a swing axis;

said swing portion dimensioned to receive said pivot pin and further dimensioned to house at least two bearing assemblies;

each of said bearing assemblies being axially disposed between said pivot pin and said interior surface;

wherein said bearing assemblies permit free rotation of said swing arm assembly about said pivot pin when said swing axis is angularly disposed with respect to the pole axis.

2. The device of claim 1 wherein each of said bearing assembly is a tapered roller bearing assembly.

3. The device of claim 1 wherein said swing portion further houses a thrust bearing assembly.

4. The device of claim 1 wherein:

said swing portion includes a first terminal end adjacent to said closed end of said housing and an opposite second terminal end;

a thrust bearing assembly is disposed adjacent said first terminal end.

5. The device of claim 1 further comprising a cam follower assembly connected to said extended portion.

6. The device of claim 5 wherein:

said extended portion includes a first end adjacent to said swing portion and an opposite second end;

said cam follower assembly being disposed adjacent to said first end.

7. The device of claim 3 wherein said pivot pin comprises a base portion and a pivot portion, said base portion fixedly attached to said closed end of the housing and said pivot portion extending upwardly from said base portion, wherein said thrust bearing assembly is disposed around said pivot portion and supported on said base portion above said closed end of the housing.

8. The device of claim 1 wherein said swing portion comprises a first terminal end adjacent to said closed end of said housing and an opposite terminal end, and further comprising a rain cap covering said opposite terminal end.

9. A fall protection device for protecting a user from falling while climbing a pole, said device comprising:

said pole having a top end and a pole axis;

a housing dimensioned to fit over the top end of said pole, said housing having a closed end and an opposite open end, wherein said top end of said pole is received through said open end and said housing is disposed on said top end of said pole;

a pivot pin fixedly connected to and extending upwardly from the closed end of said housing in a substantially vertical direction, said pivot pin;

a swing arm assembly including an extended portion connected to a hollowed swing portion, said swing portion having an interior surface and a swing axis;

said swing portion dimensioned to receive said pivot pin and further dimensioned to house at least two bearing assemblies;

each of said bearing assemblies being axially disposed between said pivot pin and said interior surface;

wherein said swing arm assembly is freely rotatable about said pivot pin even when said swing axis is angularly disposed with respect to the pole axis.

10. A method for providing fall protection from a pole having a pole axis, said method comprising:

providing said pole having said pole axis and a top end;

providing a fall protection device comprising:

a housing dimensioned to fit over the top end of said pole, said housing having a closed end and an opposite open end;

a pivot pin fixedly connected to and extending upwardly from the closed end of said housing in a substantially vertical direction;

a swing arm assembly including an extended portion connected to a hollowed swing portion, said swing portion having an interior surface and a swing axis;

said swing portion dimensioned to receive said pivot pin and further dimensioned to house at least two bearing assemblies;

each of said bearing assemblies being axially disposed between said pivot pin and said interior surface, wherein said bearing assemblies permit free rotation of said swing arm assembly about said pivot pin when said swing axis is angularly disposed with respect to the pole axis; and a safety line attached to said extended portion; and inserting said top end of said pole through said open end of said housing such that said housing is disposed on said top end of said pole with said pole axis substantially parallel to said swing axis; and attaching said safety line to a user.

11. The method of claim 10 wherein each of said bearing assembly is a tapered roller bearing assembly.

12. The method of claim 10 wherein said swing portion further houses a thrust bearing assembly.

13. A fall protection device protecting a user from falling while climbing a pole, said device comprising:

said pole having a pole axis;

a housing mounted on the pole, said housing having a closed end and an open end said closed end defining a support surface;

a swing arm assembly pivotally mounted to said housing about a swing axis coinciding with said pole axis and comprising an extended portion and a cam follower assembly, wherein said cam follower assembly is connected to said extended portion and comprises a support component spaced apart from said support surface of said housing when said swing axis and said pole axis are coincident, said support component engaging said support surface when said swing axis becomes angularly disposed with respect to said pole axis, wherein said support component is adapted to help support the extended portion in response to the weight of the user being applied to said extended portion.

14. The invention of claim 13 wherein said housing comprises a support surface, wherein said cam follower assembly engages said support surface.

15. The invention of claim 13 wherein said support component of said cam follower assembly comprises a wheel, said wheel spaced apart from said support surface of said housing when said swing axis and said pole axis are parallel and engaging said support surface when said swing axis is angularly disposed with respect to the pole axis.

16. The invention of claim 13 wherein said swing arm assembly further comprises a swing portion pivotally attached to said housing, and wherein said extended portion comprises a first and second end, said first end connected to said swing portion and said second end adapted to support said user.

17. The invention of claim 16 further comprising a pivot pin connected to said housing and a pair of bearing assemblies disposed in said swing portion around said pivot pin so as to allow said swing portion to pivot about said pivot pin.

18. The invention of claim 13 wherein said support surface is substantially horizontal.

19. A method for protecting a user from falling while climbing a pole comprising the steps of:

providing said pole characterized by a length and a circumference and having a pole axis and a top end;

providing a fall protection device comprising:

a housing having a closed end;

a pivot pin fixedly connected to and extending upwardly from the closed end of said housing in a substantially vertical direction;

a swing arm assembly including an extended portion having a first end connected to a hollowed swing portion and an opposite second end, said hollowed swing portion having an interior surface and a swing axis;

said swing portion dimensioned to receive said pivot pin and further dimensioned to house a plurality of bearing assemblies disposed between said pivot pin and said interior surface of said hollowed swing portion, said plurality of bearing assemblies comprising at least an upper and lower bearing assembly disposed axially along said pivot pin, and a thrust bearing assembly supporting said lower bearing assembly; and a safety line attached to said second end of said extended portion;

disposing said housing on said top end of said pole with said pole axis substantially parallel to said swing axis;

attaching said safety line to said user; and allowing said user to climb upwardly along the length of said pole and around said circumference of said pole while attached to said safety line, wherein said bearing assemblies permit free rotation of said swing arm assembly about said pivot pin such that less than about five pounds of force as applied by the user is required to rotate the swing arm as it is pulled by the user about the swing axis as the user climbs around said circumference of said pole.

20. The method of claim 19 wherein said fall protection device further comprises a cam follower assembly connected to said extended portion.

21. The method of claim 20 wherein said housing has a support surface, and wherein said cam follower assembly comprises a support component spaced apart from said support surface of said housing when said swing axis and said pole axis are parallel, said support component engaging said support surface when said swing axis becomes angularly disposed with respect to said pole axis.

* * * * *

UNITED STATES PATENT AND TRADEMARK OFFICE

CERTIFICATE OF CORRECTION

PATENT NO. : 6,016,889

DATED : January 25, 2000

INVENTOR(S) : James L. Pearcy et al.

It is certified that error appears in the above-identified patent and that said Letters Patent is hereby corrected as shown below:

On the Title Page

In column 1, item [75], delete "Swoodridge" and substitute --Woodridge-- in its place.

In column 2, line 3, under "ABSTRACT", delete "THe" and substitute --The-- in its place.

In column 2, line 17, under "ABSTRACT", delete "suport" and substitute --support-- in its place.

In claim 9, line 11, delete "direction, said pivot pin;" and substitute --direction;-- in its place.

In claim 15, line 5, delete "parallel" and substitute --coincident-- in its place.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*